United States Patent [19]

Daitzman

[11] 4,456,261

[45] Jun. 26, 1984

[54] METHOD OF PLAYING A BOARD GAME

[76] Inventor: Reid J. Daitzman, 1425 Bedford St., Suite 1A, Stamford, Conn. 06905

[21] Appl. No.: 307,845

[22] Filed: Oct. 2, 1981

[51] Int. Cl.[3] ..... A63F 3/00

[52] U.S. Cl. ..... 273/271

[58] Field of Search ..... 273/236, 271, 290

[56] References Cited

U.S. PATENT DOCUMENTS

| | | | |
|---|---|---|---|
| 2,368,896 | 2/1945 | Stewart | 273/271 |
| 3,072,407 | 1/1963 | Olson | 273/271 |
| 3,410,011 | 11/1968 | Bowman . | |
| 3,743,293 | 7/1973 | Chodorov . | |
| 3,747,926 | 7/1973 | Odom | 273/271 |
| 3,797,829 | 3/1974 | Heller . | |
| 4,102,535 | 7/1978 | Kindred | 273/282 |
| 4,138,120 | 2/1979 | Daitzmann | 273/271 |

*Primary Examiner*—Anton O. Oechsle

*Attorney, Agent, or Firm*—Louis H. Reens

[57] ABSTRACT

A game board device includes a game board having playing spaces arranged in a regular rectangular array of rows and columns, playing pieces divided into three sets or groups, each set or group of which is of a characteristic distinguishable from the other, the number of playing pieces of one of the sets, a "neutral" set, being equal to the number of playing spaces, while the number of playing pieces of each of the other sets, the "assigned" sets, are equal to each other and, respectively, to one-half the number of playing spaces. The distinguishable characteristics may be different colors, or different shapes although the characteristics lend themselves to many variations including being representative of themes to make the game more appealable to players of certain age groups. In the method, the playing pieces are distributed equally to the players and a characteristic of one of the equal number sets assigned to each player with the object of the game being to have three or four of the assigned characteristics in a linear alignment, whether horizontal, vertical, or diagonal. However, the assigned characteristic playing pieces cannot be placed in position on a playing space until placed on top of a playing piece of the neutral characteristic previously placed on that space. Each player places either a neutral characteristic playing piece or an assigned characteristic playing piece for every move. Once a piece is on the board it remains.

2 Claims, 4 Drawing Figures

METHOD OF PLAYING A BOARD GAME

BACKGROUND OF THE INVENTION

My invention relates to a board game and more particularly to a board game device and method utilizing strategic placement of playing pieces and alignment thereof in a specific pattern for scoring Games involving moves of playing pieces over a board having a pattern and relying on alignment of the playing pieces to determine the scoring are well known. Generally, such games are based on principles similar to those used in tic-tac-toe in which each player seeks to play his pieces to achieve scoring alignment, or to block an opponent from such scoring alignment, in a strategic race to a finish. In some such games, for example, that shown in U.S. Pat. No. 2,368,896, the element of chance is further introduced in that, although the board game playing discs are marked "O" or "X", the player must select a disc at random and is unaware of its marking until it is to be played. U.S. Pat. No. 3,743,293 discloses a game utilizing a board surface having a rectangular grid of sixteen openings and sixteen spherical elements that relies on chance reversal of the colors of the spherical playing elements. Instead of utilizing alignment for scoring, alignment is utilized to determine the moves for reversing the color of the elements with each player proceeding in alternate moves. The player who must reverse the last element is the loser.

In U.S. Pat. No. 3,747,926, there is disclosed a tic-tac-toe alignment game in which playing pieces of three different colors or shapes are placed in one playing area. The playing area receives a playing piece from each of the three groups of playing pieces which are drawn in turn by each player. Points are awarded to the player completing a row of identical pieces by placing the last of such a piece in a row in tic-tac-toe fashion. In one embodiment, translucent colored playing pieces are used on an illuminated surface to provide additional colors by placement on top of each other during successive turns. Other variations on tic-tac-toe have utilized playing elements offering more than two choices of shape or color. For example, U.S. Pat. No. 3,410,011 discloses a game display unit having an array of display elements arranged in a series of rows extending in two directions, each element of which has a body rotatable about a shaft and is provided with a series of display faces, preferably three, for exposure in different rotary positions so that the number of possible patterns for a tic-tac-toe type of game is increased. The game board disclosed in U.S. Pat. No. 3,797,829 is to a similar effect although utilizing rotatably mounted indicia bearing balls arranged in a series of rows and columns. The indicia on each ball, a plurality of different colored spots, are preferably arranged in pairs in diametrically opposed relation. The arrangement of spots and pairs is such that the pattern formed by one player is different from the pattern formed by a player on the other side of the board as a consequence of which one player cannot anticipate the plans and moves of his opponent.

A regular rectangular grid board game disclosed in U.S. Pat. No. 4,102,535 utilizes a plurality of first playing pieces each of which has one of two contrasting characteristics and which is placed on the playing areas according to selection by a player. Second playing pieces are in the form of apertured plates which overlie the playing areas of the board and through which the first playing pieces are viewable, according to different patterns, to ascertain scoring. U.S. Pat. No. 4,138,120 discloses a board game which is challenging to both youngsters and adults in which the concept involved in tic-tac-toe is expanded so that not merely shape but another concept, such as shape and color, is involved. Each playing piece is designed to exhibit two physical characteristics relating to such concepts. Points are scored for three or four like characteristics in series on a regular rectangular board. Exemplary is a four by four grid board using sixteen playing pieces comprised of four sets of four pieces in each set each of which have different characteristics.

Thus, it can be seen that there have been many prior art attempts to devise games based on tic-tac-toe principles but which can also provide more interesting appeal from the standpoint of game structure and aesthetics as well as greater challenges in order to attract and hold the attention of the players. However, as can be seen from several of the patents discussed above, some such attempts have resulted in games with physical structure that is comparatively complex and expensive to manufacture and purchase as well as inconvenient to use. Alternatively, in other games where interest has been added primarily through the element of chance the interest provided by strategy and the educational value of the game has been diminished. Accordingly, the prior art solutions to developing games of greater interest and challenge than single concept games such as tic-tac-toe, for play by adults as well as children, have been many and varied and frequently not commercially sucessful. Thus, there remains a need for a board game device and method which relies on familiar principles for playing and scoring but which nevertheless provides a greater challenge in the play of the game itself, without complexity in the rules involved, while at the same time providing educational value along with entertainment and which is economical to manufacture and durable for long use.

SUMMARY OF THE INVENTION

The above-mentioned disadvantages associated with several of the prior art type of board games are overcome by my invention which provides a board game device which is simple to fabricate and longlasting, is adaptable to many different formats and variations, may be set up and maintained with minimum effort and utilizes a playing method which is both educational and entertaining, and is readily learned and played by children and adults while at the same time providing interest and challenge to both.

The foregoing is achieved, according to my invention, through the provision of a game board device comprising a game board having playing spaces arranged in a regular rectangular array of rows and columns, playing pieces divided into three sets or groups, each set or group of which is of a characteristic distinguishable from the other, the number of playing pieces of one of the sets, a "neutral" set, being equal to the number of playing spaces, while the number of playing pieces of each of the other sets, the "assigned" sets, are equal to each other and, respectively, to one-half the number of playing spaces. The distinguishable characteristics may be different colors, such as blue, red and white, or different shapes although the characteristics lend themselves to many variations including being representative of themes to make the game more appealable to players of certain age groups.

Therefore, an object of my invention is the provision of a method of playing a board game which requires a board game device having a board with a regular rectangular grid defining an array of playing spaces and playing pieces of one characteristic sufficient to cover each playing space on the array once and playing pieces of at least two other characteristics, equal in number to one another and each, respectively, totaling in number one-half the number of playing spaces.

The playing pieces are distributed equally to the players and a characteristic of one of the equal number sets assigned to each player with the object of the game being to have three or four of the assigned characteristics in a linear alignment, whether horizontal, vertical, or diagonal. However, the assigned characteristic playing pieces cannot be placed in position on a playing space until placed on top of a playing piece of the neutral characteristic previously placed on that space. Each player places either a neutral characteristic playing piece or an assigned characteristic playing piece for every move. Once a piece is on the board it remains. The number of moves in the game therefore equals twice the number of playing spaces.

Therefore, a further object of my invention is the provision of a method of playing a board game to align playing pieces in a linear pattern for scoring.

The foregoing and additional objects, features and advantages of my invention will be further apparent from the following description of preferred embodiments thereof taken in conjunction with the accompanying drawings and the claims.

DESCRIPTION OF THE PREFERRED EMBODIMENTS

Figure 1:
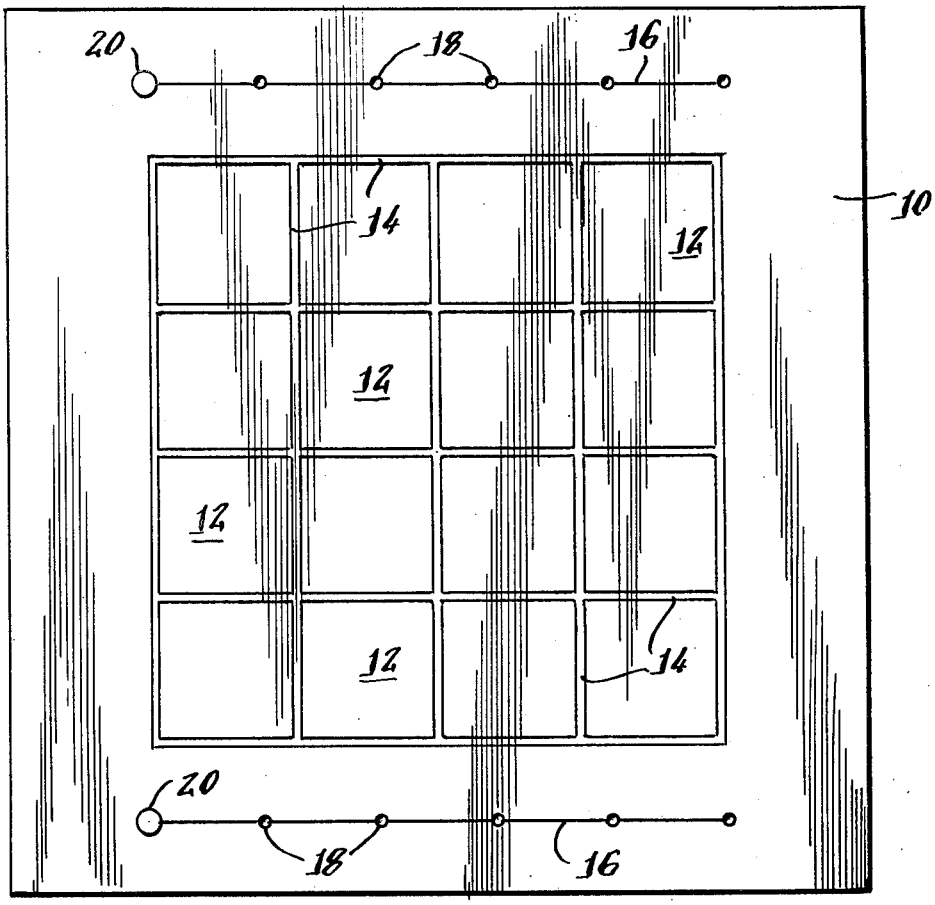
FIG. 1 is a top plan view of a game board used in a game board device according to an embodiment of my invention.

Referring to FIG. 1, there is shown a game board 10 for use in the board game device of my invention. The upper surface of the board is divided into a plurality of equal playing spaces 12 by lines 14 so as to result in a regular rectangular array having an equal number of rows and columns. In the embodiment shown, the board 10, fabricated from heavy plastic material known as "Lucite", is divided into sixteen squares comprised of four rows and four columns by score lines. Adjacent to the array or grid of playing spaces 12 are scoring areas 16 which each comprise a plurality of linearly aligned holes 18 in which a peg 20 may be moved for indicating the score.

Figure 2:
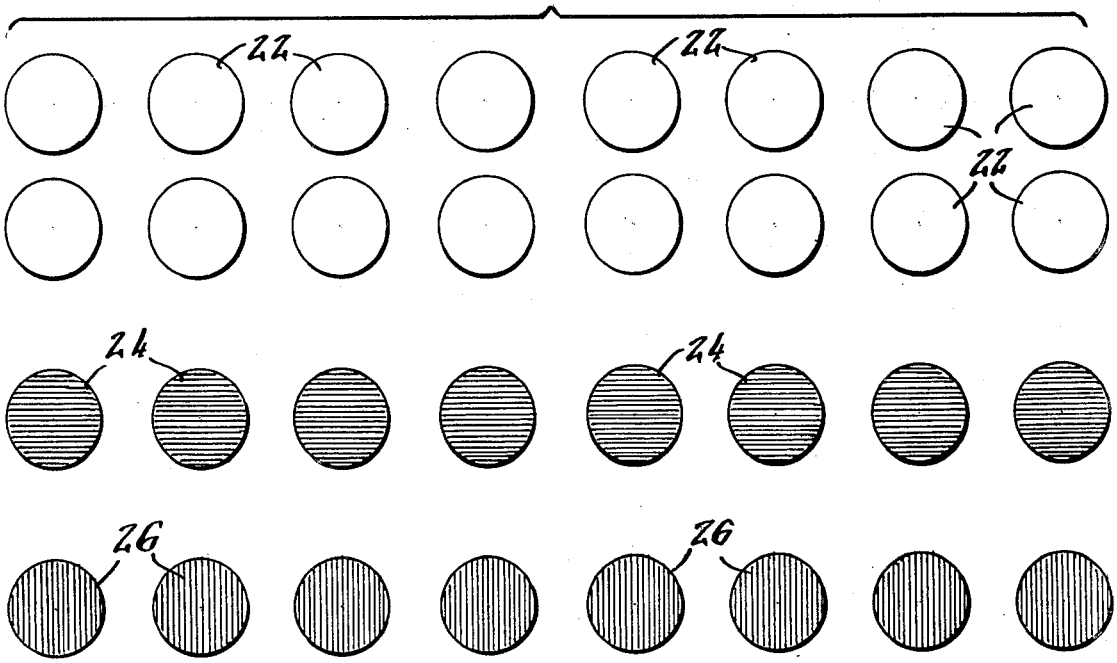
FIG. 2 is a top plan view of the playing pieces used in a game board device according to an embodiment of my invention showing the pieces lined for distinguishing color characteristics, blue, red and white.

The playing elements or pieces of the board game device are shown in FIG. 2. The total number of playing pieces equals twice the number of playing spaces or squares 12 and are divided into three groups or sets. There is a first set of "neutral" characteristic playing pieces 22 which equal in number the number of playing spaces 12. There is a second set of playing pieces of a different characteristic 24 which equal in number one-half the number of playing spaces 12 and a third set of playing pieces of yet a different characteristic 26 which also equal in number one-half the number of playing spaces 12. These pieces are referred to as the "assigned" playing pieces.

The three different characteristics of the playing pieces may comprise any distinguishable characteristic which may be ascertained visually or by touch or even by mechanical or electrical sensors. The distinguishable characteristic shown illustrated in FIG. 2 is color. The first or neutral characteristic pieces 22 are white, the assigned second characteristic pieces 24 are blue and the assigned third characteristic pieces 26 are red. The different characteristics could also be predicated upon physical shape or other recognizable formats. For example, the playing pieces can be flat tiles with indicia thereon which relate to themes appropriate to adults or children. For example, such playing pieces featuring themes for children are shown in FIG. 3 illustrating a playing piece 28 showing a gingerbread man, a playing piece 30 showing a duck and a playing piece 32 showing a bear, which may take the place of the white, blue and red colors, respectively.

The game is played according to a method which also employs strategy in an effort to linearly align pieces of an assigned characteristic in order to score points. The method teaches skill in determining moves to outwit an opponent in an educational and entertaining exercise. Considering the embodiment of a four by four grid or array of playing spaces and pieces of different colors, a preferred method of playing the game will now be described.

The playing pieces are distributed to, for example, two players. Player A receives four red, four blue, and eight white pieces, while player B receives the identical pieces in the same proportions. Player A is assigned the characteristic red and Player B is assigned the characteristic blue. The object of the game is to have three or four of the color assigned to one in linear alignment, that is, a row, whether horizontal, vertical or diagonal. The blue or red assigned color pieces cannot be placed in scoring position on the playing spaces until a neutral white piece has been placed on that space. Both players place either a white, blue or red for every move. Once a piece is on the board it remains. The game on a four by four grid therefore consists of 32 moves.

Figures 3, 4:
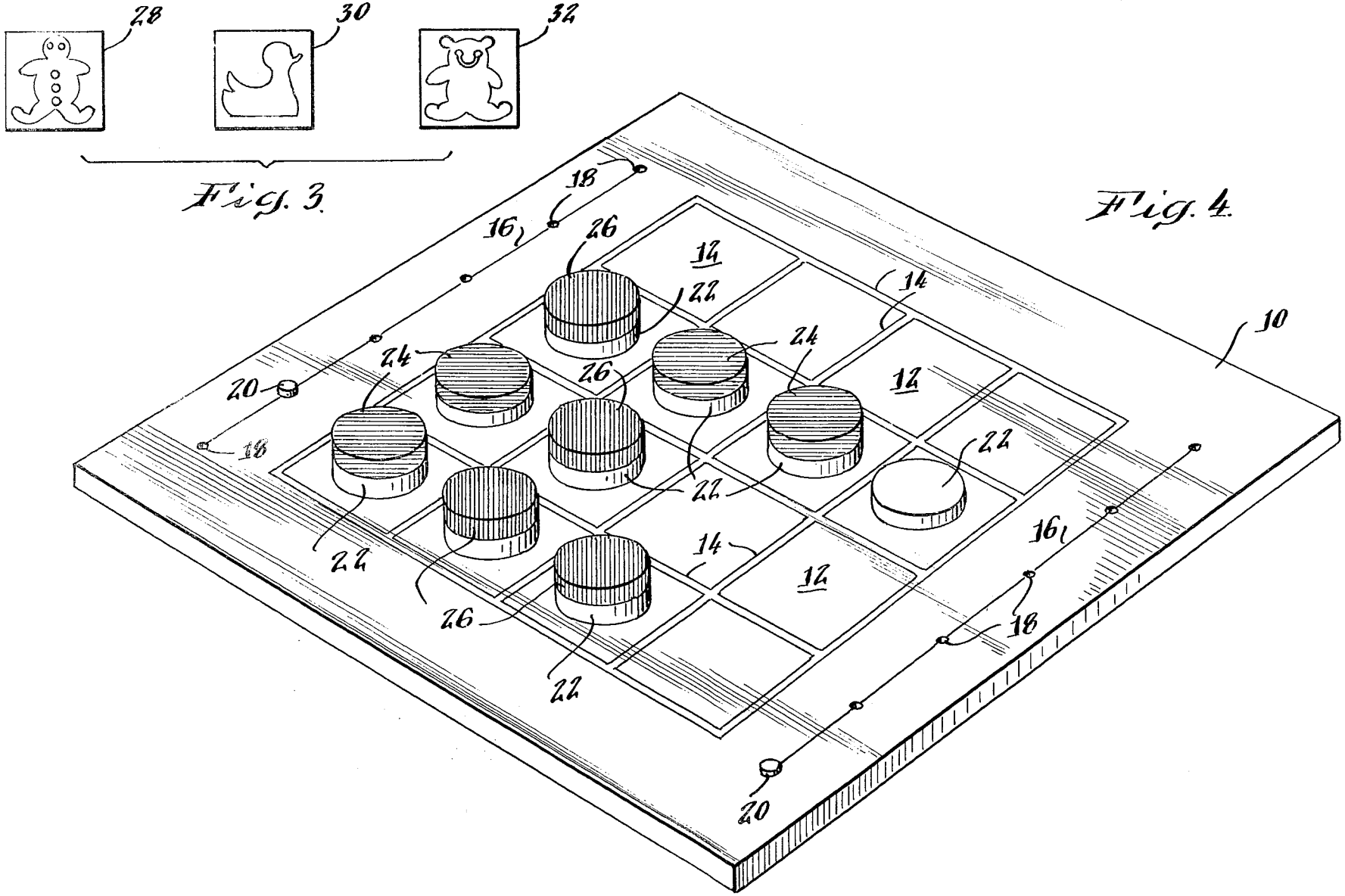
FIG. 3 is a top plan view of playing pieces according to another embodiment of my invention illustrating characteristics of themes for children.
FIG. 4 is a top perspective view of the board game device according to an embodiment of my invention illustrating a game in progress.

Referring to FIG. 4, there is shown an illustration of a game in progress. As can be seen by the number of pieces played, seven moves have occurred in the game in progress. From the position of the scoring pegs 20 in the holes 18 it can be seen that one player, playing the red pieces 26, has already scored in the game. The pieces which have been played include nine of the white pieces 22, four of the blue pieces 24, and four of the red pieces 26. Scoring will occur when three or four pieces are aligned. The alignment of four pieces will terminate the game and make the player who achieves that alignment the winner of that game while the alignment of three pieces will result in a score for movement of the peg. The game continues until all pieces are played and therefore each player may score in a game. The object is not only to score but to prevent the other player from scoring. Therefore, one of the strategies will be to play the pieces appropriately so that the other player is kept from scoring four in a row and winning the entire game in contrast to merely attempting to score oneself through an alignment of three in a row.

It will be understood by those skilled in the art that the embodiment illustrated is merely exemplary and that variations on the physical construction, the number of spaces in the array, the characteristics of the playing pieces and the like may occur. For example, the game board can be made of materials other than plastic such as a thin sheet of cardboard or a pad of disposable printed "board" sheets. It can also be made foldable as is known in the art.

The game board device and method may also be embodied in an electronic form using a video-type display. The comparative simplicity of construction of the preferred embodiment is a feature which makes the game particularly adaptable to many variations to provide interest for players of all age groups. For example, as illustrated in FIG. 3, the pieces can be representative of themes. In addition to those themes illustrated in FIG. 3, playing pieces can be provided which develop more active interest. Accordingly, for children, the white pieces could be expressed as horses while the red pieces can be expressed as indians and the blue pieces as cowboys.

Adult variations can include stakes playing in which players place a bet on the colored pieces and receive monies for each three in a row with the object being to win the stake of an opponent in a series of games. The game is also adaptable to a computerized format since each of the playing pieces can be considered cells, that is, sixteen spaces are cells in a four by four grid that can be provided with two "keys" for activation and automatic scoring. A cell is activated before the scoring piece is inserted. Appropriate sensors can sense the presence of pieces and the pieces themselves may furnish signals. Those skilled in the art will be familiar with means for adapting the format and method of playing and scoring to a computerized video display mode of the type in popular use today. The game can be also provided as a portable embodiment played on a miniature grid such as folded paper or magnetized board or the like. These variations are all by way of example and not limitation since many other combinations are possible.

I claim:

1. A method for aligning elements in a linear pattern to determine scoring in an educational and entertaining exercise comprising selecting a plurality of spaces arranged in a regular rectangular array, selecting a plurality of elements for placement in the spaces, the elements being divided into three sets each of which possesses a characteristic distinguishing it from the other set, the number of elements in a first set being equal to the number of spaces, the number of elements in each of the second and third sets being equal to each other and, respectively, to one-half the number of playing spaces, distributing the elements equally to each of two positions, alternately locating one element in a space from each of the two positions, locating the elements of the first set in the space before locating any elements of the other two sets therein, locating no more than two elements in a space and determining a score when at least three of the elements of either the second or third set are linearly aligned.

2. A method as claimed in claim 1 wherein the plurality of spaces selected comprises sixteen arranged in an array of four rows and four columns.

* * * * *